US007234768B2

(12) United States Patent
Manning

(10) Patent No.: US 7,234,768 B2
(45) Date of Patent: Jun. 26, 2007

(54) REVERSIBLE CHAIR

(76) Inventor: Michael Eugene Manning, 15219 Stuebner Airline #55, Houston, TX (US) 77069

( * ) Notice: Subject to any disclaimer, the term of this patent is extended or adjusted under 35 U.S.C. 154(b) by 0 days.

(21) Appl. No.: 11/281,190

(22) Filed: Nov. 16, 2005

(65) Prior Publication Data

US 2007/0108805 A1 May 17, 2007

(51) Int. Cl.
*A47C 7/40* (2006.01)

(52) U.S. Cl. ..... 297/94; 297/97; 297/383; 297/488

(58) Field of Classification Search ..... 297/94, 297/95, 97, 100, 104, 411.29, 411.32, 354.1, 297/383, 487, 488, 124–127, 173, 464, 283.2–283.3
See application file for complete search history.

(56) References Cited

U.S. PATENT DOCUMENTS 188,592 A * 3/1877 Coburn ..... 297/116
692,333 A * 2/1902 Orr ..... 297/94
1,178,285 A * 4/1916 Adams ..... 297/97
1,449,401 A * 3/1923 Headley ..... 297/363
1,685,770 A * 10/1928 Bowen ..... 297/326
3,807,799 A * 4/1974 Freedman ..... 297/411.32
3,811,701 A * 5/1974 Grime ..... 280/753
3,874,476 A * 4/1975 Monaghan ..... 280/753
3,888,329 A * 6/1975 Monaghan ..... 280/734
4,429,918 A * 2/1984 Alsup et al. ..... 297/353
4,452,487 A * 6/1984 Plowman ..... 297/411.35
4,470,629 A * 9/1984 Collins, Jr. ..... 297/64
4,668,010 A * 5/1987 Fujiwara ..... 297/150
5,765,911 A * 6/1998 Sorenson ..... 297/173
5,791,736 A * 8/1998 Herbert ..... 297/452.21
6,457,773 B1 * 10/2002 Gates ..... 297/228.12
6,877,812 B2 * 4/2005 Congleton et al. ..... 297/353

* cited by examiner

*Primary Examiner*—Peter R. Brown
(74) *Attorney, Agent, or Firm*—Wong, Cabello, Lutsch, Rutherford & Brucculeri, LLP

(57) ABSTRACT

A reversible chair is disclosed which permits the user to sit with either a conventional backrest or to rest his or her chest against the same element in a "forward chair" configuration. The rest is attached to the seat with a side-mounted support arm such that no central support must be straddled when the chair is used as a forward chair. In certain embodiments, the rest is moveable from a backrest position to a front rest position. In this way, the user may face the same direction on the seat in either configuration thereby permitting optimal contouring of the seating surface. In yet other embodiments, the attachment of the rest to the seat is adjustable in a fore and aft direction. Armrests are provided in certain embodiments which are moveable from a position which extends from the front of the back/front rest to a position which extends from the opposite side of the rest.

11 Claims, 3 Drawing Sheets

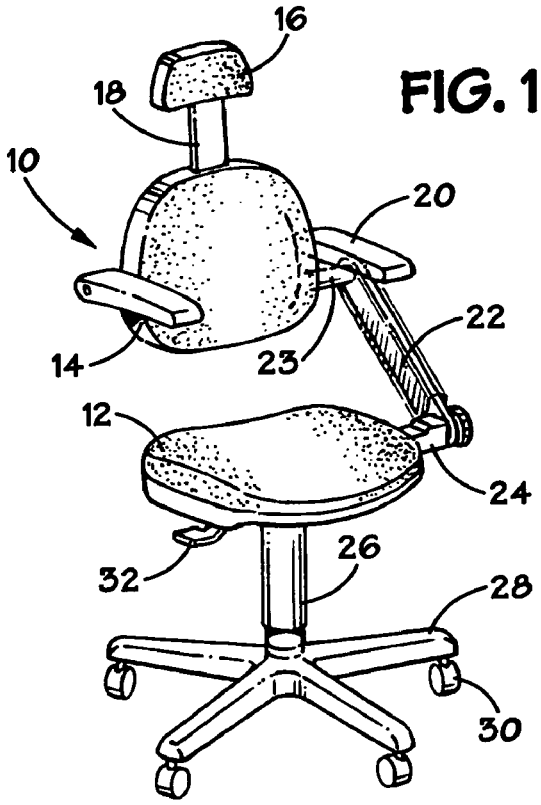
FIG. 1
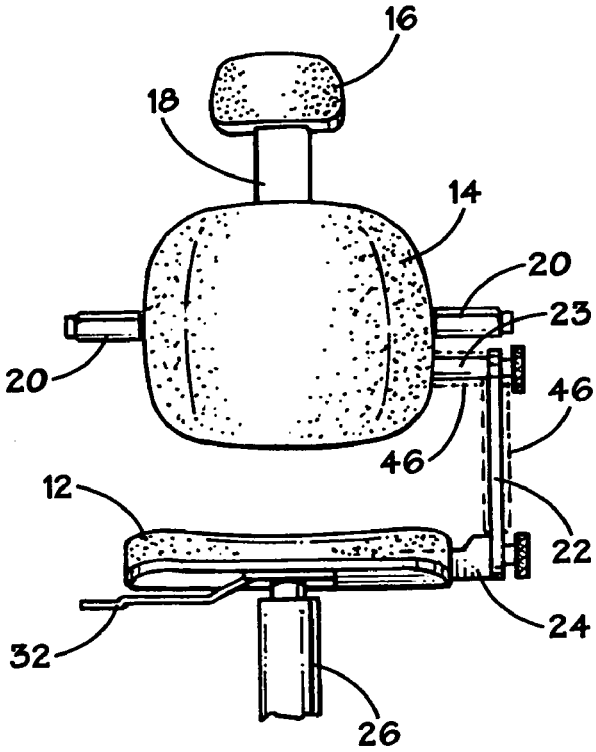
FIG. 2
FIG. 3
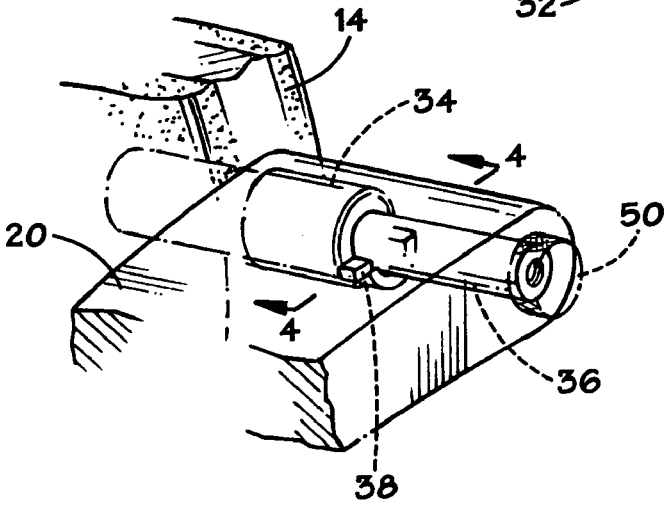
FIG. 4
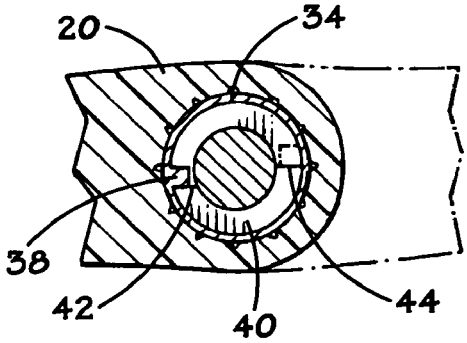

REVERSIBLE CHAIR

CROSS-REFERENCE TO RELATED APPLICATIONS

None

BACKGROUND OF THE INVENTION

1. Field of the Invention

This invention relates to chairs. More particularly, it relates to "forward" chairs—i.e., chairs which provide support for the front or chest of the user.

2. Description of the Related Art

For the last century, work chairs in schools, factories and offices have been designed for sitting upright, with the hip, knees and ankles all at right angles. Until recently, it was widely believed that people sat with a 90-degree bending of the hip joint while preserving concavity of the back. In 1953, J. J. Keegan, an American Orthopedic surgeon, made a series of x-rays of people lying on their sides which documented the large movements that took place in the lumbar section of the spinal column as the position changed from standing to right angle sitting and bent-over positions. In the natural resting position, as when one lies on one's side while sleeping, the lumbar curve is retained and the muscles are relaxed and well-balanced. A sitting posture that approaches the natural resting position, is a more suitable position and allows the spine to carry the body weight in a more comfortable way. A seat that tilts forward encourages this natural posture. Opposing muscle groups are balanced and the lumbar curve is preserved producing balanced seating in which the back is straight, the joint angles are open and the muscles are relaxed. This position provides greater mobility and relieves pressure on the lungs, stomach and spine vertebrae.

A conventional chair which tilts forward leaves the back of the user unsupported. To rectify this situation, "forward" chairs have been developed which replace the conventional backrest with a front or chest rest.

In the past, forward chairs have been equipped with a center-mounted rest for supporting the chest of the user. Typically, the center-mounting means has comprised a post attached to the seat that the user must straddle with his or her legs while seated in the chair. This configuration is awkward for the user to enter inasmuch as he or she must swing one leg around the post. Moreover, female users wearing dresses or skirts must move their clothing to a position which accommodates the post.

Forward chairs of the prior art commonly function well only when the user sits in them facing the rest. The forward mode, however, may not be suitable for all tasks. Accordingly, it has been necessary in the past to have different chairs for forward and conventional seating.

The present invention solves these problems.

BRIEF SUMMARY OF THE INVENTION

A chair according to the present invention may have a side-cantilevered rest which may be configured as either a conventional backrest or as a rest for the front or chest of the user. In certain embodiments, armrests are provided which may pivot about mounting points on the back/front rest such that they may be used on either side of the back/front rest.

In one particular embodiment of the invention, the cantilevered rest is adjustable in a fore and aft direction to suit the anatomy and seating position of the user.

BRIEF DESCRIPTION OF THE SEVERAL VIEWS OF THE DRAWING(S)

FIG. 1 is a perspective view of one embodiment of the invention.

FIG. 2 is a front view of the seat and back/front rest portions of the chair shown in FIG. 1.

FIG. 3 is a perspective view, partially in phantom, of the armrest pivot mechanism of the chair shown in FIG. 1.

FIG. 4 is a cross-sectional view taken along line 4-4 in FIG. 3.

DETAILED DESCRIPTION OF THE INVENTION

Figure 5:
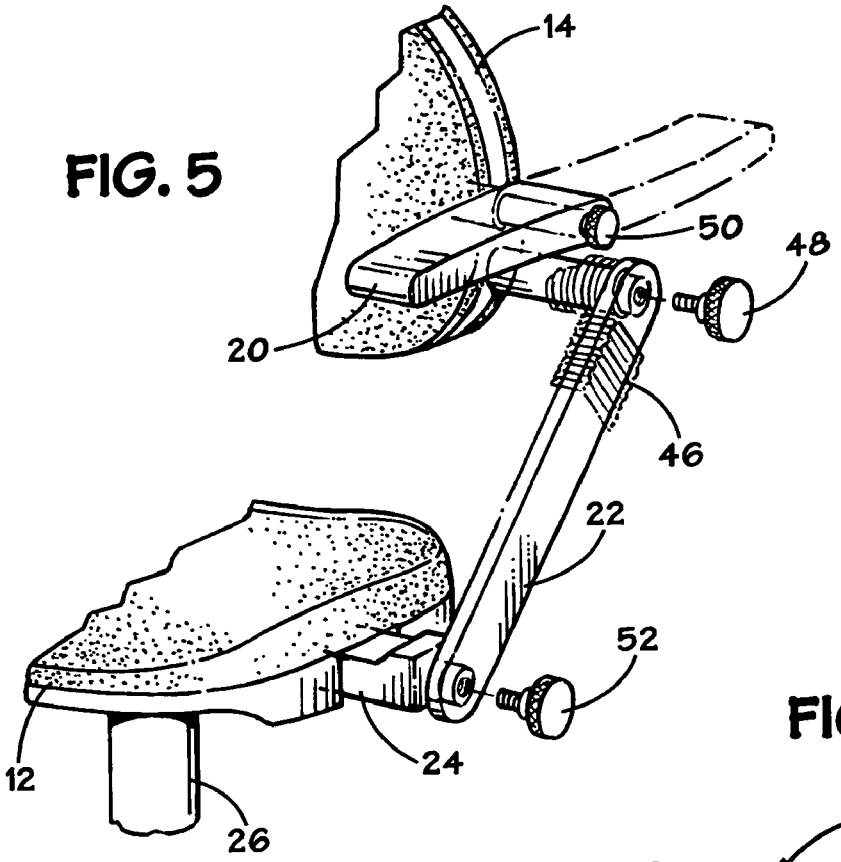
FIG. 5 shows details of the front/back rest support means.

FIG. 1 shows one particular embodiment of the invention as chair 10 which comprises seat 12, supported by seat support column 26 mounted on a conventional 5-member array of legs 28 each having a caster 30 near its distal end. Support column 26 may comprise a gas cylinder actuated by seat height adjustment lever 32 for adjusting the height of seat 12 relative to the legs 28. Other height adjustment means conventional in the art may be used in connection with support column 26—for example, a threaded rod or a ratchet mechanism. Support column 26 may also include swivel means for allowing seat 12 to rotate relative to the base comprising legs 28 and may also include tilt means for tilting seat 12 relative to the base.

Chair 10 may also comprise reversible front/back rest 14. As shown in FIGS. 1 and 2, rest 14 is positioned as a conventional backrest. Chair 10 may comprise headrest 16 connected to rest 14 by adjustable headrest support 18 which may allow the height of headrest 16 to be varied relative to front/back rest 14 to suit a particular person seated in the chair.

Left and right armrests 20 may also be provided on rest 14. One particular attachment means for armrests 20 is shown in FIG. 3.

In the illustrated embodiment, front/back rest 14 is connected to seat 12 by cantilevered rest support arm 22. One end of support arm 22 attaches to rest mounting arm 23 on rest 14; and, the opposing end of support arm 22 attaches to rest support mount 24 on seat 12. As shown in FIG. 5, support arm 22 may attach to rest support mount 24 with threaded knob 52 which may permit user adjustment of the angle between rest support mount 24 and arm 22. Similarly, support arm 22 may attach to rest mounting arm 23 with threaded knob 48 which may allow user adjustment of the angle of rest 14 relative to seat 12. Arm 22 and/or 23 may have covering 46 which may comprise padding, upholstery material, plastic, leather, or any other suitable material.

Figure 9:
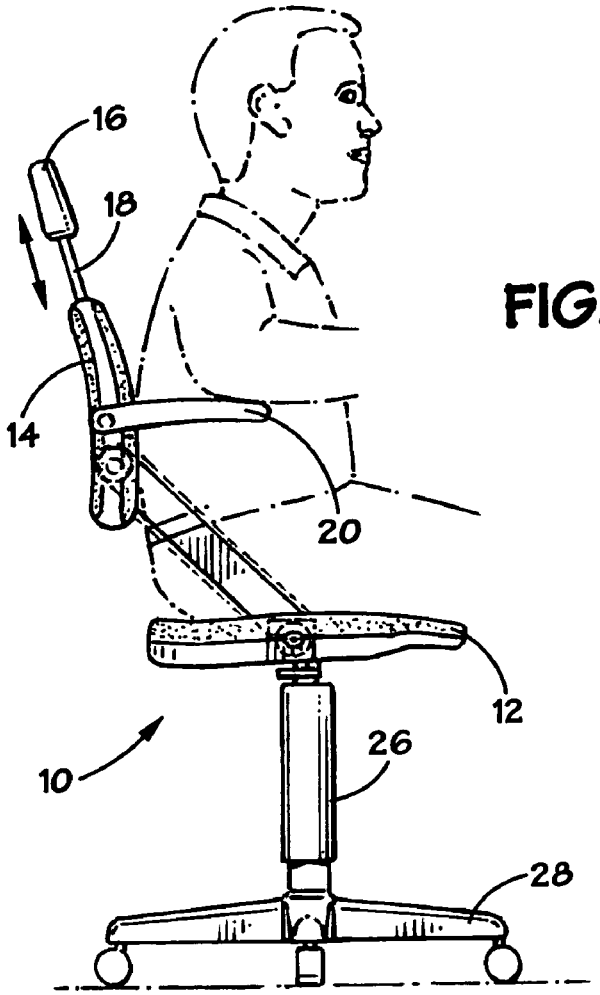
FIG. 9 shows a user seated in the chair configured in the backrest mode.
Figure 10:
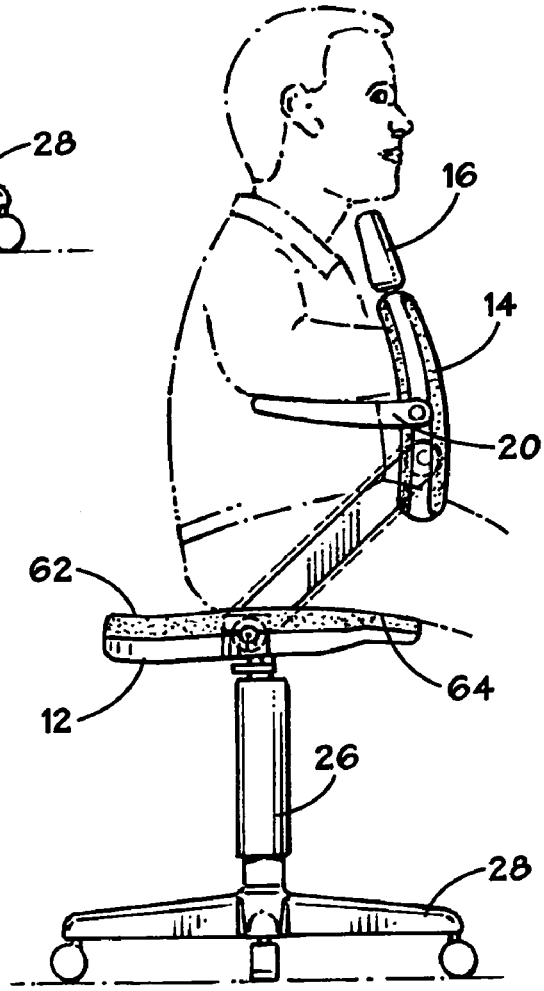
FIG. 10 shows a user seated in the chair configured in the frontrest or "forward" mode.

Cantilevered support arm 22 when pivotably mounted to rest mounting arm 23 and seat mount 24 permits chair 10 to be reversed from a conventional seating configuration (as shown in FIG. 9) to the forward chair configuration shown in FIG. 10. By reversing the position of rest 14, the user may maintain his or her seating direction on seat 12—i.e., seat 12 may be contoured for optimal comfort in a single seating direction. In certain embodiments, this may take the form of a slight elevation 62 in the rear of the seat and a rolled front edge (or "waterfall" front) 64 that avoids interference with circulation in the user's thighs by preventing undo pressure behind the knees. In embodiments of chair 10 wherein cantilevered support arm 22 is fixed to rest 14 and seat mount 24, the user must reverse his or her seating position on seat 12 to use chair 10 as a forward chair. In such embodiments, seat 12 may have a generally flat seating surface or the seating surface may be symmetrically contoured such that the user may comfortably sit facing in either direction. It will also be appreciated that a chair according to the present invention may have a cushioned lumbar support for supporting the lower back of a user when using the chair in conventional configuration—i.e., with a backrest. In non-reversible chairs of the prior art, lumbar supports are disadvantageous inasmuch as a backrest having a lumbar support would press into the abdomen of the user when using the same surface as a front rest.

Figure 6:
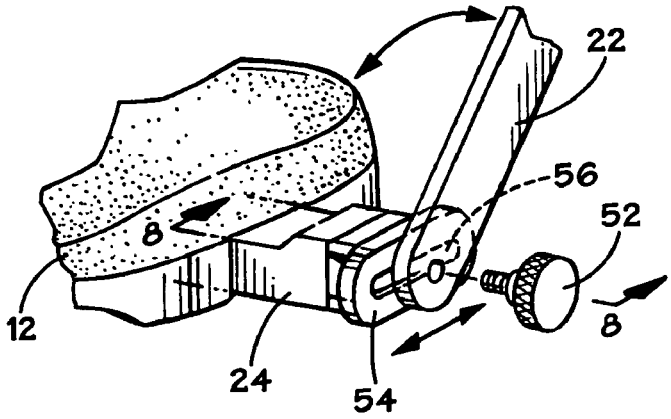
FIG. 6 illustrates an adjustable embodiment of the front/back rest support attachment.
Figure 7:
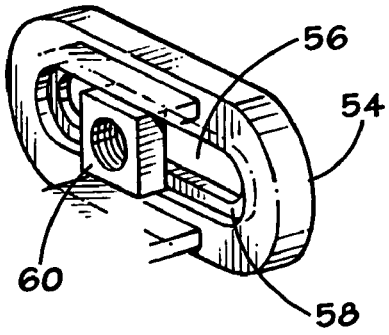
FIG. 7 is a rear view of the seat-mounted portion of the support attachment shown in FIG. 6.
Figure 8:
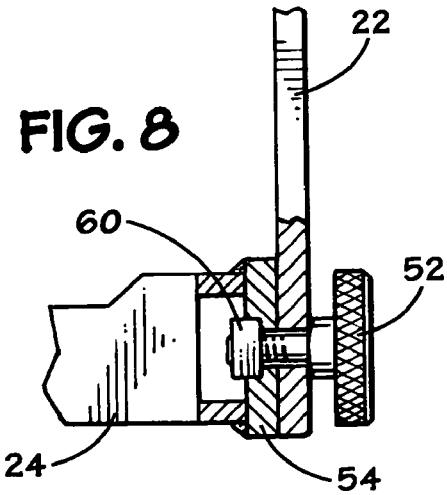
FIG. 8 is a cross-sectional view taken along line 8-8 in FIG. 6.

An alternative embodiment of the connection means for support arm 22 is shown in FIGS. 6, 7 and 8. In this embodiment, the lower pivot point of support arm 22 (threaded knob 52) is adjustable in a fore and aft direction. Adjustable mount 54 is attached to rest support mount 24 on seat 12. Adjustable mount 54 comprises slot 56 having shoulder 58. Slot 56 is dimensioned to permit sliding engagement of square nut 60. Nut 60 is sized to engage threaded knob 52. When sufficiently tightened, nut 60 bears against shoulder 58 and the frictional forces between support arm 22 and adjustable mount 54 fix the position of support arm 22 relative to mount 24. In use, adjustable mount 54 enables the user to position rest 14 fore and aft relative to seat 12. In certain embodiments, the optimum position of rest 14 (at a given elevation) when chair 10 is in the backrest configuration may not correspond to the optimum position of rest 14 when chair 10 is configured as a forward chair (by simply pivoting arm 22 on knob 52). Adjustable mount 54 allows fore and aft adjustment of rest 14 to accommodate this difference.

It has been found that armrests on a forward chair may be advantageously configured to extend either toward the front or back of the rest (as shown in phantom in FIG. 5). One particular mechanism for reversing armrests 20 on reversible chair 10 is shown in FIGS. 3 and 4. Armrest 20 may have bushing 34 configured for sliding engagement with armrest support pivot 36 on back/front rest 14. Stop 40 has first surface 42 and second surface 44 which limit the movement of dog 38 on the inner surface of bushing 34. Armrest 20 may be secured in a selected position by tightening knob 50.

Although the invention has been described in detail with reference to certain preferred embodiments, variations and modifications exist within the scope and spirit of the invention as described and defined in the following claims.

What is claimed is:

1. A chair comprising:

a substantially horizontal seating surface having a front, a back and a pair of opposing sides;

a substantially vertical rest surface having a front, a back, a top, a bottom and a pair of opposing sides;

at least one armrest support pivot connected to and extending from at least one side of the vertical rest surface said support pivot having a first stop surface and a second stop surface;

a support arm on only one side of the seating surface connecting said one side of the seating surface to one side of the rest surface;

at least one armrest connected to at least one side of the rest surface and having a bushing engaging the armrest support pivot, the bushing having a dog on its internal surface such that it is moveable from a first position wherein it projects substantially from the front of the rest surface and the dog is in contact with the first stop surface to a second position wherein it projects substantially from the back of the rest surface and the dog is in contact with the second stop surface.

2. A chair comprising:

a substantially horizontal seating surface having a front, a back and a pair of opposing sides;

a substantially vertical rest surface having a front, a back, a top, a bottom and a pair of opposing sides;

a support arm on only one side of the horizontal seating surface and having a first end and an opposing second end, the first end pivotably connected to said one side of the seating surface and the second end pivotably connected to one side of the rest surface; and, at least one armrest connected to at least one side of the rest surface such that it is moveable from a first position wherein it projects substantially from the front of the rest surface to a second position wherein is projects substantially from the back of the rest surface.

3. A chair as recited in claim 2 further comprising means for securing the armrest in a selected position.

4. A chair as recited in claim 2 further comprising a first stop which prevents the armrest from moving past the first position and a second stop which prevents the armrest from moving past the second position.

5. A chair comprising:

a substantially horizontal seating surface having a front, a back and a pair of opposing sides;

a substantially vertical rest surface having a front, a back, a top, a bottom and a pair of opposing sides;

a support arm on only one side of the seating surface and having a first end and an opposing second end, the second end pivotably connected to one side of the rest surface and the first end pivotably connected to a sliding fitting on said one side of the seating surface such that the pivot point of the first end may be adjusted fore and aft relative to the seating surface.

6. A chair as recited in claim 5 further comprising at least one armrest connected to at least one side of the rest surface such that it is moveable from a first position wherein it projects substantially from the front of the rest surface to a second position wherein it projects substantially from the back of the rest surface.

7. A chair as recited in claim 6 further comprising a first stop which prevents the armrest from moving past the first position and a second stop which prevents the armrest from moving past the second position.

8. A chair as recited in claim 5 wherein the front of the seating surface is depressed relative to the middle of the seating surface and the back of the seating surface is elevated relative to the middle of the seating surface.

9. A chair as recited in claim 5 further comprising means for securing the first end of the support arm at a selected angle relative to the seating surface.

10. A chair as recited in claim 5 further comprising a lumbar support in the front of the vertical rest surface.

11. A chair comprising:

a substantially horizontal seating surface having a front, a back and a pair of opposing sides;

a substantially vertical rest surface having a convex front, a concave back, a top, a bottom and a pair of opposing sides;

a support arm on only one side of the horizontal seating surface and having a first end and an opposing second end, the first end pivotably connected to said one side of the seating surface and the second end pivotably connected to one side of the rest surface; and, a lumbar support in the front of the vertical rest surface.

* * * * *